US007600996B2

(12) United States Patent
Ruan

(10) Patent No.: US 7,600,996 B2
(45) Date of Patent: Oct. 13, 2009

(54) LIGHTER

(75) Inventor: Jun Jun Ruan, Monterey Park, CA (US)

(73) Assignee: Toyo Lighter Co., Monterey Park, CA (US)

( * ) Notice: Subject to any disclaimer, the term of this patent is extended or adjusted under 35 U.S.C. 154(b) by 831 days.

(21) Appl. No.: 11/151,398

(22) Filed: Jun. 14, 2005

(65) Prior Publication Data

US 2006/0281034 A1 Dec. 14, 2006

(51) Int. Cl.
*F23Q 2/16* (2006.01)
*F23Q 2/46* (2006.01)

(52) U.S. Cl. ..... 431/153; 431/277

(58) Field of Classification Search ..... 431/153, 431/277

See application file for complete search history.

(56) References Cited

U.S. PATENT DOCUMENTS 4,830,603 A * 5/1989 Cirami ..... 431/153
4,832,596 A * 5/1989 Morris, Sr. ..... 431/153
5,002,482 A * 3/1991 Fairbanks et al. ..... 431/277
5,240,408 A * 8/1993 Uematsu et al. ..... 431/153
5,547,370 A * 8/1996 Hwang ..... 431/276
5,584,682 A * 12/1996 McDonough et al. ..... 431/153
5,655,901 A * 8/1997 Makoto ..... 431/153
5,697,775 A * 12/1997 Saito et al. ..... 431/153
5,967,768 A * 10/1999 Saito et al. ..... 431/153
5,971,749 A * 10/1999 Chen ..... 431/153
6,042,367 A * 3/2000 Saito et al. ..... 431/153
6,086,359 A * 7/2000 Sher ..... 431/153
6,213,759 B1 * 4/2001 Sung ..... 431/153
6,722,877 B2 * 4/2004 Wang et al. ..... 431/153
6,887,072 B2 * 5/2005 Judeng ..... 431/153
7,001,175 B2 * 2/2006 Yang ..... 431/153

* cited by examiner

*Primary Examiner*—Carl D Price

(57) ABSTRACT

A safety gas lighter with a loosely mounted striking wheel, comprises a lighter body, topped by a lighter head, an gas release valve, a pressing lever for gas release, a spring, a flint, and a wheel assembly with an axle. The diameter of the axle integrated with the first side wheel is smaller than the diameter of the inner opening of the striking wheel, and the diameter of side wheels are larger than diameter of striking wheel. When in use, because and the diameter of side wheels are larger than diameter of striking wheel, the thumb would strike the side wheels first. For children, because their hands are small, and their strengths cannot be compared with the adults, they can only rotate side wheels, but cannot rotate steel wheels, so the children cannot light fire using the lighter. When adults are using the lighter, their hands will strike the side wheels as well as the striking wheel, to make the side wheels and striking wheel rotate simultaneously. The striking wheel will touch the flint, to generate sparks, and light fires. Because children would not be able to light the fire, only adults can light the fire, the lighter is a safety type lighter.

8 Claims, 4 Drawing Sheets

LIGHTER

FIELD OF THE INVENTION

The present invention relates to a safety gas lighter. More particular, the present invention relates to a safety gas lighter wherein the striking wheel is loosely mounted on an axle.

BACKGROUND OF THE INVENTION

A conventional gas lighter using striking wheel and flint are easy to use, reliable and production cost is low. However, children may accidentally operate it and cause fire and/or burn injury. Therefore, safety measures are needed in order to prevent accidental operations by children.

Many types of safety devices were developed. In U.S. Pat. No. 5,846,069, a rotatable wheel hood having a safety position and an activation position is placed over the striking wheel. In U.S. Pat. No. 6,860,733, a ratchet-pawl mechanism was used. In U.S. Pat. No. 6,716,024, a pair of brake discs and a pair of brake devices are placed outside of the two driving wheels. In U.S. Pat. No. 5,520,197, two brake members work in conjunction of the two turning wheels to stop the rotation of the striking wheel assembly. These designs all added more components in the lighters, increased the cost, and it is possible that mal-function will occur, cannot guarantee safety.

SUMMARY OF THE INVENTION

Accordingly, the present invention presents a safe and simple design to prevent accidental operations by children and easy to use for adults.

A safety gas lighter with a loosely mounted striking wheel comprises a lighter body, topped by a lighter head, a gas release valve, a pressing lever for gas release, a spring, a flint, and a wheel assembly with an axle. In one preferred embodiment of the present invention, the first end of the axle of the wheel assembly is fixed to the first side wheel of the wheel assembly, the second side wheel is mounted to the second end of the axle, while a striking wheel is loosely mounted on the axle and between the first and second side wheel. The outside diameter of the striking wheel is smaller than the outside diameters of the first and second side wheel. The inside diameter of the striking wheel is larger than the outside diameter of the axle. Therefore, if only the first and second side wheels are stroked by a thumb, the striking wheel will not turn, and the safety gas lighter of the present invention will not light a fire; however when extra force is used, the thumb will press more inward, and the striking wheel will be stroked to rotate and generate sparks to light a fire.

For children, because their hands are small, and their strengths cannot be compared with the adults, they can only rotate side wheels, but cannot rotate striking wheel, so the children cannot light fire when they play with the lighter. When adults are using the lighter, their hands will touch the side wheels as well as the striking wheels, to make the side wheels and striking wheel rotate simultaneously. The striking wheel will touch the flint, to generate sparks, and light fires. Because children would not be able to light fire, only adults can light fire, the lighter is a safety type lighter.

BRIEF DESCRIPTION OF DRAWINGS

The present invention will in more detail be described with reference to the drawings, in which.

DETAILED DESCRIPTION OF PREFERRED EMBODIMENT

Figure 1:
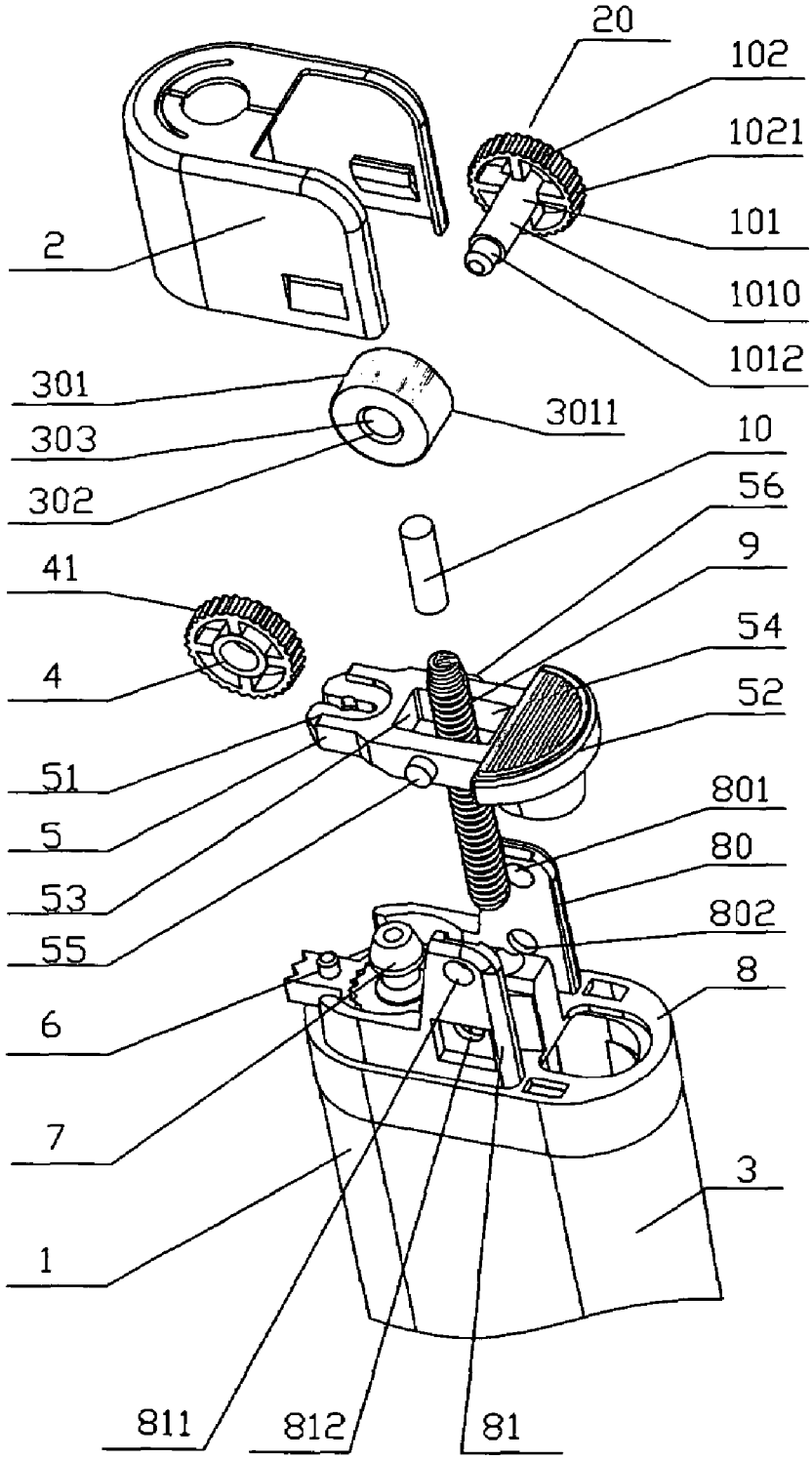
FIG. 1 is an exploded view of the lighter of the present invention.
Figure 2:
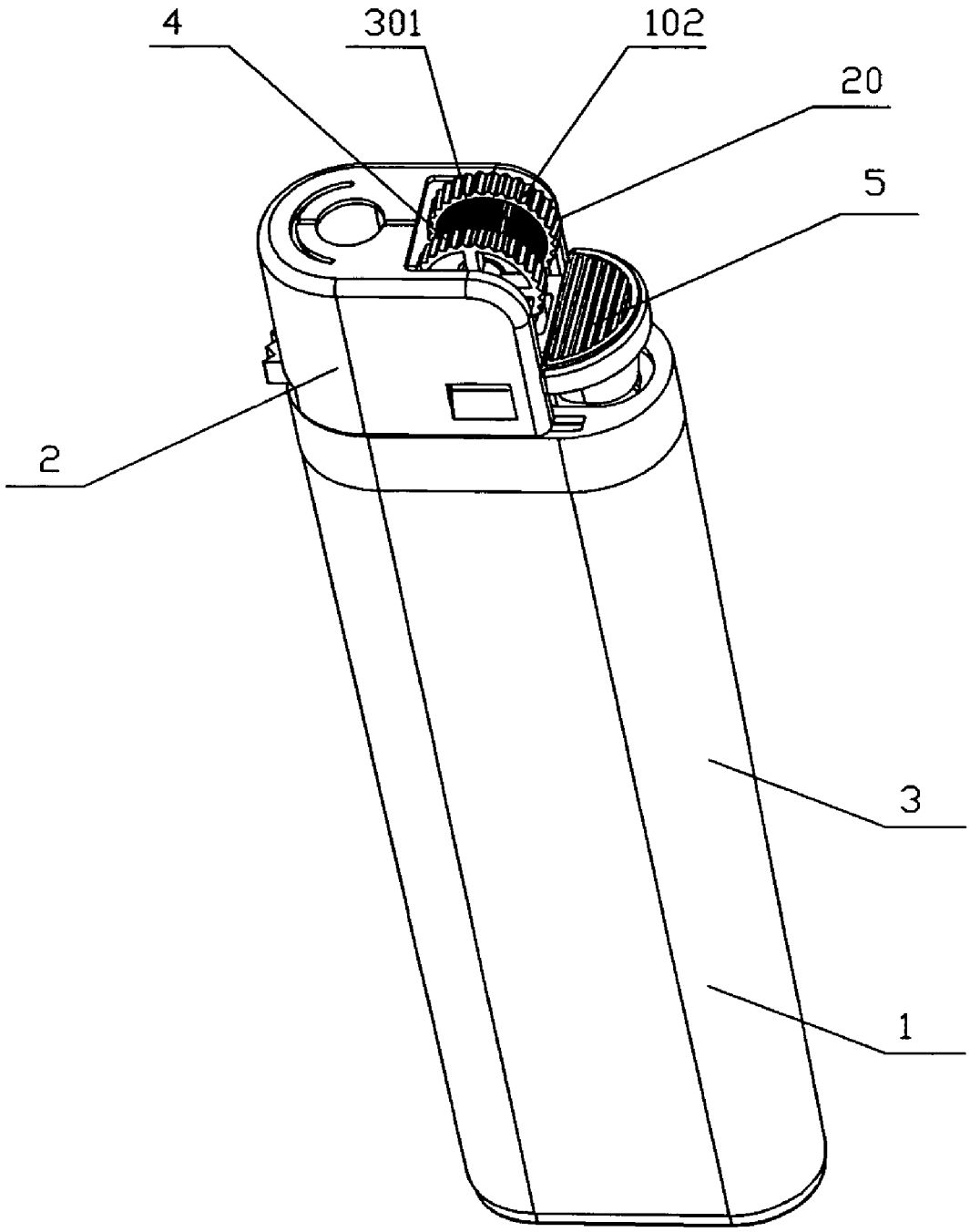
FIG. 2 is a perspective view of the lighter of the present invention.

As shown in FIG. 1, FIG. 2, FIG. 3, and FIG. 4, a safety gas lighter 1 with a loosely mounted striking wheel, comprises a lighter body 3 containing fuels for the lighter 1; topped by a lighter head 8 having a gas release valve 7, a flame adjusting ring 6, a pair of supporting frame 80 and 81, and a lighter head inner surface 82 defining a lighter head inner cavity 83; a pressing lever 5 for gas release having a cover end 51, a press end 52, a lever inner surface 53 defining a lever inner opening 54, and a pair of lever axles 55 and 56; a spring 9 located inside the lighter head inner cavity 83 and constrained by the lighter head inner surface 82; a flint 10 located inside the lighter head inner cavity 83 and constrained by the lighter head inner surface 82; a wheel assembly comprising a first side wheel 102 having a first side wheel outer surface 1021, an axle 101 having an axle outer surface 1010, a first axle end 1011 and a second axle end 1012, a second side wheel 4 having a second side wheel outer surface 41 and a second side wheel inner surface 42, and a striking wheel 301 having a striking wheel outer surface 3011 and a striking wheel inner surface 302 defining a striking wheel inner opening 303, wherein the striking wheel inner opening 303 is in a cylinder shape; and a windshield cover 2 covering the lighter head 8. The supporting frame 80 and 81 comprises a first pair of mounting holes 801, 811, and a second pair of mounting holes 802, 812 respectively. The pair of lever axles 55 and 56 are pivotally mounted on the supporting frame 80 and 81 at the second pair of mounting holes 802 and 812 respectively, wherein the cover end of the pressing lever 5 covers the gas release valve 7 in ordinary position, wherein when the press end 52 of the pressing lever 5 is pressed down, the cover end 51 of the pressing lever 5 will go up, and uncover the gas release valve 7, and then the fuel inside the lighter body 3 will be released to provide fuel for the safety gas lighter 1. The released gas from the gas release valve 7 will go upwards and fill the space within the windshield cover 2. Release the pressing lever 5, the cover end 51 comes down, and the gas release valve 7 is closed, and the fuel supply is stopped.

Figure 3:
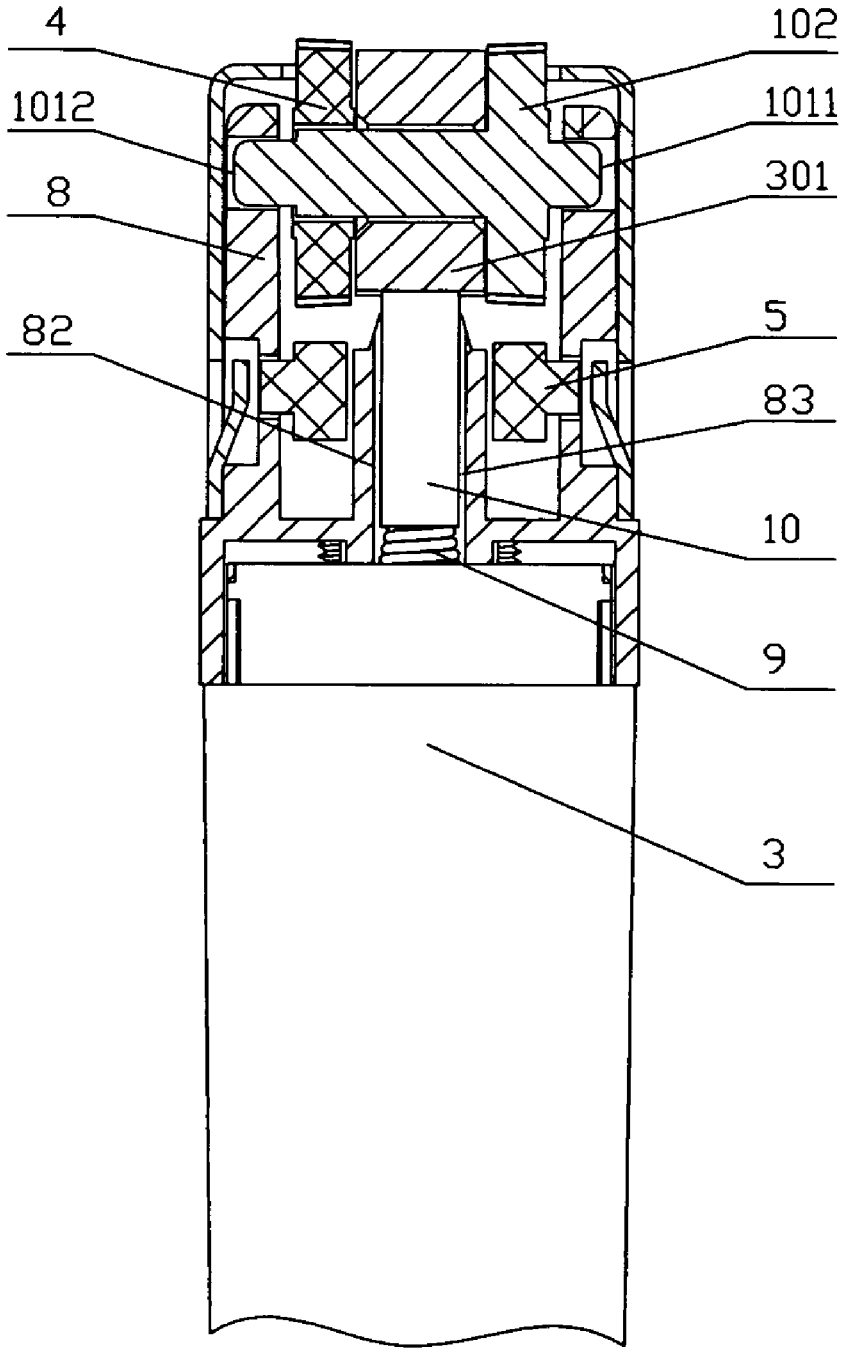
FIG. 3 is a front view of the cross section of the present invention.
Figure 4:
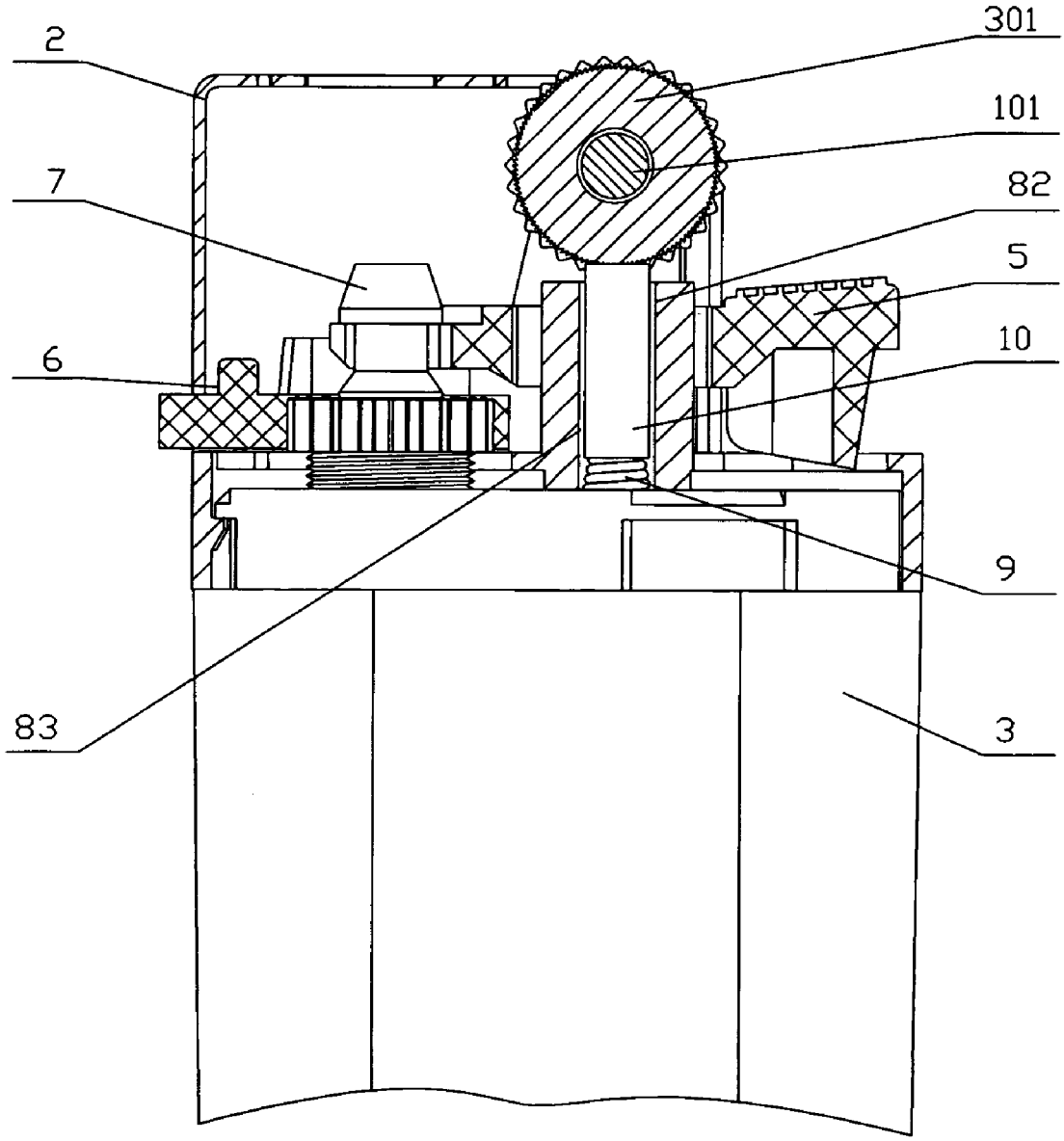
FIG. 4 is a side view of the cross section of the present invention.

In the preferred embodiment of the present invention, as seen in FIG. 1, FIG. 3 and FIG. 4, the first side wheel 102 is fixed to the first axle end 1011, wherein the second side wheel 4 is mounted to the second axle end 1012, and can be removed from the second axle end 1012. The axle 101 is rotatably mounted on the supporting frames 80 and 81, wherein the first axle end 1011 and the second axle end 1012 are mounted on the first pair of mounting holes 801, 811 respectively. The striking wheel 301 is rotatably mounted on the axle 101 between the first side wheel 102 and the second side wheel 4, wherein the axle 101, the first side wheel 102, the second side wheel 4, and the striking wheel 301 are in cylinder shape, wherein the diameter of the striking wheel inner opening 303 is larger than the diameter of the axle 101, wherein the diameter of the striking wheel 301 is smaller than the diameter of the first side wheel 102 and the diameter of the second side wheel 4, wherein the rotation of the striking wheel 301 is independent from the rotation of the first side wheel 102, the second side wheel 4, and the axle 101. Preferably, the axle outer surface 1010 and the striking wheel inner surface 302 are smooth surfaces, while the first side wheel outer surface 1021, the striking wheel outer surface 3011 and the second side wheel outer surface 41 are tooth like surfaces for better contact with the thumb. The flint 10 is supported by the spring 9 on the bottom, going through the lever inner opening 53 of the pressing lever 5 and restrained by the striking wheel 301 on the top and in contact with the striking wheel 301, wherein when the striking wheel rotates, the flint 10 will be stroked to generate sparks. When the pressing level 5 is pressed down at the same time, the gas release valve 7 will release gas, to be lighted by the sparks and provides fire.

In the present invention, if only the first side wheel 102 and the second side wheel 4 are stroked by a thumb, the first side wheel 102, the second side wheel 4, and the axle 101 will rotate, but the striking wheel will not rotate, and the safety gas lighter 1 will not light a fire. When extra force is used, the thumb will press more inward, and the striking wheel will be stroked to rotate and generate sparks to light a fire. For small children, their thumbs are small, and their strengths are weak, the chance of them accidentally lighting fires by the safety gas lighter of the present invention is small. For adults, a little bit of extra force is needed to use the safety gas lighter of the present invention, but no significant difference. It is still easy to use.

In normal operation, the striking wheel is rotated and the press end 52 of the pressing lever 5 is pressed virtually simultaneously, that means the gas is released by the gas release valve 7 while sparks are generated when the flint 10 is rubbed. The sparks ignite the fuel gas and a flame is maintained so long as the press end 52 of the pressing lever 5 is pressed downward. The flame adjusting ring 6 can be adjusted to control the magnitude of the fire.

In one alternative embodiment, the striking wheel 301 can be fixed to the axle 101, and the first side wheel 102 and the second side wheel 4 can be pivotally mounted to the axle 101, wherein when the thumb strikes the first side wheel 102 and the second side wheel 4, only the first side wheel 102 and the second side wheel 4 will rotate. The axle 101 and the striking wheel 301 will not rotate, unless the striking wheel 301 is stroked by the thumb directly.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included without departing from the scope or spirit of the invention as defined in the following claims.

What is claimed is:

1. A safety gas lighter with a loosely mounted striking wheel comprises:

a lighter body for containing fuel;

a lighter head on top of the lighter body and connected with the lighter body, comprising a gas release valve, and a pair of supporting frames, and a lighter head inner surface defining a lighter head inner cavity;

a pressing lever pivotally mounted on the lighter head;

a spring located inside the lighter head inner cavity and supported by the lighter head inner surface;

a flint located inside the lighter head inner cavity and on top of the spring and supported by the lighter head inner surface;

a wheel assembly, comprising a first side wheel, an axle having an axle outer surface, a second side wheel, and a striking wheel having an striking wheel inner surface defining a striking wheel inner opening, wherein the axle, the first side wheel, the second side wheel, the striking wheel, and the striking wheel inner opening are in cylinder shape respectively;

wherein the axle comprises a first axle end and a second axle end, and is rotatably mounted on the supporting frames of the lighter head respectively;

wherein the first side wheel is mounted to the first axle end, wherein the second side wheel is mounted to the second axle end;

wherein the striking wheel is rotatably mounted on the axle between the first side wheel and the second side wheel, wherein the diameter of the striking wheel inner opening is larger the diameter of the axle, wherein the diameter of the striking wheel is smaller than the diameter of the first side wheel and the second side wheel respectively;

wherein the rotation of the striking wheel is independent from the rotation of the first side wheel, the second side wheel, and the axle respectively;

wherein the striking wheel is in contact with the flint, wherein when the striking wheel rotates, the flint is stroked to generate sparks;

wherein when the pressing lever is pressed down, the gas release valve releases fuel gas, wherein the first side wheel is fixed to the first end of the axle, wherein the second side wheel is coupled to the second end of the axle in a rotatable manner.

2. A safety gas lighter with a loosely mounted striking wheel comprises:

a lighter body for containing gas;

a lighter head on top of the lighter body and connected with the lighter body, comprising a gas release valve, and a pair of supporting frames, and a lighter head inner surface defining a lighter head inner cavity;

a pressing lever pivotally mounted on the lighter head;

a spring located inside the lighter head inner cavity and supported by the lighter head inner surface;

a flint located inside the lighter head inner cavity and on top of the spring and supported by the lighter head inner surface;

a wheel assembly, comprising a first side wheel, an axle, a second side wheel, and a striking wheel, wherein the axle, the first side wheel, the second side wheel, and the striking wheel, are in cylinder shape respectively;

wherein the axle comprises a first end and a second end, and is rotatably mounted on the supporting frames;

wherein the first side wheel is mounted to the first axle end, wherein the second side wheel is rotatably mounted to the second axle end;

wherein the striking wheel is mounted on the axle between the first side wheel and the second side wheel, wherein the diameter of the striking wheel is smaller than the diameter of the first side wheel and the diameter of the second side wheel respectively;

wherein the rotation of the striking wheel is independent from the rotation of the first side wheel, and the second side wheel respectively;

wherein the striking wheel is in contact with the flint, wherein when the striking wheel rotates, the flint will be stroked to generate spark;

wherein when the pressing level is pressed down, the gas release valve will release gas.

3. The safety gas lighter as claimed in claim 2, wherein the press lever further comprises a cover end, a press end, a lever inner surface defining a lever inner opening, and a pair of lever axes, wherein the flint goes through the lever inner opening, wherein the pair of lever axes are pivotally mounted on the pair of supporting frames of the lighter head respectively, wherein the cover end closes the gas release valve in normal position, wherein when the press end is pressed down, the cover end will go up and uncover the gas release valve to release fuel gas.

4. The safety gas lighter as claimed in claim 3, wherein the pair of supporting frame of the lighter head further comprises a first pair of mounting holes, and a second pair of mounting holes, wherein the first axle end and the second axle end are rotatably mounted to the first pair of mounting holes respectively, wherein the pair of lever axes are pivotally mounted on the second pair of mounting holes respectively.

5. The safety gas lighter as claimed in claim 2, wherein the pair of supporting frame of the lighter head further comprises a first pair of mounting holes, and a second pair of mounting holes, wherein the first axle end and the second axle end are rotatably mounted to the first pair of mounting holes respectively, wherein the press lever are pivotally mounted to the second pair of mounting holes respectively.

6. The safety gas lighter as claimed in claim 2, wherein the striking wheel is rotatably mounted on the axle.

7. The safety gas lighter as claimed in claim 2, further comprises a flame adjustment ring.

8. The safety gas lighter as claimed in claim 2, further comprises a windshield cover.

* * * * *